US007673471B2

(12) United States Patent
Egan et al.

(10) Patent No.: US 7,673,471 B2
(45) Date of Patent: Mar. 9, 2010

(54) REFRIGERATION APPLIANCE WITH EXTERNALLY ACCESSIBLE DISPENSER

(75) Inventors: Martin Shawn Egan, Evansville, IN (US); Bobbie J. Gilman, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 12/017,359

(22) Filed: Jan. 22, 2008

(65) Prior Publication Data

US 2008/0110198 A1 May 15, 2008

Related U.S. Application Data

(62) Division of application No. 11/201,977, filed on Aug. 11, 2005, now Pat. No. 7,343,757.

(51) Int. Cl.
*B67D 5/62* (2006.01)

(52) U.S. Cl. ..... 62/389; 222/146.6

(58) Field of Classification Search ..... 62/389–400; 222/146.6

See application file for complete search history.

(56) References Cited

U.S. PATENT DOCUMENTS

| | | | | |
|---|---|---|---|---|
| 2,914,218 | A * | 11/1959 | Korodi | 222/131 |
| 3,653,532 | A | 4/1972 | Mann | |
| 3,834,178 | A * | 9/1974 | Pink | 62/338 |
| 5,791,523 | A | 8/1998 | Oh | |
| 5,901,562 | A | 5/1999 | Tunzi et al. | |
| 6,019,477 | A | 2/2000 | Wegrzyn | |
| 6,763,976 | B2 | 7/2004 | Mitchell | |
| 6,804,974 | B1 | 10/2004 | Voglewede et al. | |
| 7,007,500 | B2 * | 3/2006 | Lee | 62/389 |
| 7,076,966 | B2 * | 7/2006 | Mullen | 62/337 |
| 7,201,005 | B2 * | 4/2007 | Voglewede et al. | 62/126 |
| 2003/0090890 | A1 | 5/2003 | Miozza et al. | |

FOREIGN PATENT DOCUMENTS

| | | |
|---|---|---|
| FR | 1476903 | 4/1967 |
| WO | 03/009723 A1 | 2/2003 |
| WO | 2006/021809 A2 | 3/2006 |

* cited by examiner

*Primary Examiner*—William E Tapolcai
(74) *Attorney, Agent, or Firm*—Kirk W. Goodwin; Greer, Burns & Crain Ltd

(57) ABSTRACT

A refrigeration appliance is provided which includes a cabinet with a first openable door providing access to a first refrigeration compartment and a second openable door providing access to a second refrigeration compartment. The second openable door has a portion thereof positioned below a portion of the first openable door. A rail separates the first refrigeration compartment and the second refrigeration compartment. A water dispenser is contained in the rail, as well as electronic controls for the refrigeration appliance. The dispenser is arranged to be stationary relative to the refrigeration appliance while the doors are open or closed. The rail may be removed and replaced, and with the water and electronic controls located in the rail, repairs are performed more efficiently and flexibility in manufacturing is enhanced. A drip tray is formed in an exterior side of the second openable door below the dispenser. When the door is opened, the drip tray moves away from the dispenser, permitting the dispenser to be used with larger receptacles than can be accommodated with the drip tray under the dispenser.

18 Claims, 6 Drawing Sheets

REFRIGERATION APPLIANCE WITH EXTERNALLY ACCESSIBLE DISPENSER

CROSS-REFERENCE TO RELATED APPLICATIONS

The present application constitutes a divisional application of U.S. patent application Ser. No. 11/201,977, allowed, entitled "INTEGRATED CENTER RAIL DISPENSER" filed Aug. 11, 2005.

BACKGROUND OF THE INVENTION

The present invention relates generally to refrigeration devices with dispensers, such as water dispensers.

Refrigeration appliances with dispensers, such as door mounted water dispensers are well known, such as disclosed in U.S. Pat. Nos. 6,804,974 and 6,763,976. In such arrangements, the dispenser is located in a door of the appliance, accessible only from an exterior of the appliance. This requires that water and electronics pathways are routed from the back of the refrigerator, then inside the cabinet (to the cooling reservoir for the water), back outside the cabinet (room temperature) to the bottom hinge area. Depending on the swing of the door selected by the user, the water and electric lines are routed through one of the hinges and into the door, past special skirts to prevent wear to the lines when the door opens and closes. This type of assembly requires multiple sub-assemblies and routing of both water and electrical lines along the sides of the cabinet and then through the hinges.

U.S. Pat. No. 2,914,218 discloses a refrigeration appliance having a dispenser resting on a floor of a compartment and extending through a contoured recess in the upper door. No drip tray is provided for this appliance, and no electronic controls are associated with the dispenser.

U.S. Pat. No. 6,019,477 discloses a side-by-side refrigeration appliance where a door for one of the compartments has a portion positioned below a portion of a door for the other compartment, even through the doors are side-by-side. In the embodiment of FIG. 4, a dispenser is located in a central region between the two doors and in between the overlying portions. No drip tray is provided in an openable door for this embodiment. It is not disclosed whether any electronic controls are associated with the dispenser.

U.S. Published application US2003/0090890 discloses a refrigeration appliance having a mullion assembly positioned in the interior of the appliance that includes an electronic control. The mullion assembly is not accessible from the exterior of the appliance, and can only be accessed when the appliance door is open. The mullion assembly includes lighting assemblies for providing illumination above and below the mullion assembly.

It would be an improvement in the art if a refrigeration appliance were provided with a dispenser which is accessible from the exterior or the interior of the appliance, depending on the open or closed position of the appliance door, and wherein a drip tray is provided for the dispenser in the door, which may be moved out of the way when the door is opened.

SUMMARY OF THE INVENTION

The present invention, in an embodiment, provides a refrigeration appliance which includes a cabinet with a single liner secured in the cabinet and defining an open volume within the cabinet. A removable and replaceable rail is engageable with the liner to separate the open volume into a first refrigeration compartment and a second refrigeration compartment. A first openable door provides access to the first refrigeration compartment. A second openable door provides access to the second refrigeration compartment. A water dispenser is contained in the horizontal rail and held stationary in the refrigeration appliance. The water dispenser is arranged to be accessible from a front of the refrigeration appliance while the doors are both open and closed.

An electronic user interface may also be contained in the horizontal rail and held stationary in the refrigeration appliance to be accessible from the front of the refrigeration appliance while the doors are in an open position as well as in a closed position.

The rail may be slidable relative to the liner during insertion and removal of the rail.

In an embodiment, as many of the water components of the appliance, such as all of the water components are located in the rail. In an embodiment, as many of the electronic control components of the appliance, such as all of the electronic control components, are located in the rail. Such an arrangement will reduce the wiring and plumbing complexity of the refrigeration appliance, and will also allow for several different models of the appliance to be made from a single liner and shell configuration, with only the rail with its various water and electronic control components changed between models, to provide different combinations of features in different models, while allowing for manufacturing flexibility. Further, if a water component or a control component fails or needs repair, the entire rail can be removed and replace with a new rail, so that the components can be repaired at a repair facility, rather than in the field, resulting in quicker and more efficient service calls.

In an embodiment, the present invention provides a refrigeration appliance which includes a cabinet with an openable door providing access to a refrigeration compartment. A dispenser is contained in the refrigeration appliance, accessible from an exterior of the refrigeration appliance while the door is closed, and from an interior of the appliance while the door is open, and arranged to be stationary relative to the refrigeration appliance while the door is opening or closing. A drip tray is formed in an exterior side of the openable door below the dispenser. In an embodiment, the drip tray is formed in a top and front surface of the door. When the door is opened, the drip tray moves away from the dispenser, permitting the dispenser to be used with larger receptacles than can be accommodated with the drip tray.

In an embodiment of the invention, the refrigeration appliance comprises a cabinet with a first openable door providing access to a first refrigeration compartment and a second openable door providing access to a second refrigeration compartment. The second openable door has a portion thereof positioned below a portion of the first openable door. A rail separates the first refrigeration compartment and the second refrigeration compartment. A dispenser is contained in the rail. The dispenser is arranged to be stationary relative to the refrigeration appliance while the doors are open or closed. A drip tray s formed in an exterior side of the second openable door below the dispenser.

In an embodiment, the first refrigeration compartment is a freezer compartment maintained at a temperature below the freezing temperature of water.

In an embodiment, the said second refrigeration compartment is a fresh food compartment maintained at a temperature above the freezing temperature of water.

In an embodiment, the first refrigeration compartment and the second refrigeration compartment are formed in the appliance by a plastic liner defining the rear and side walls of the compartments, and the horizontal rail comprises a separate unit which slidingly mates with the side walls to define a bottom wall of the first compartment and a top wall of the second compartment.

In an embodiment, the horizontal rail extends to the rear wall of the compartments and an air flow passage is formed in the horizontal rail to permit a flow of air to at least one of the compartments. In such an arrangement, a water supply conduit may lead from the horizontal rail through a rear wall of the refrigeration appliance and to an exterior of the cabinet.

In a specific embodiment, the refrigeration appliance comprises a first refrigeration compartment accessible through an openable door and a second refrigeration compartment accessible through an openable door positioned below said first refrigeration compartment. A horizontal rail separates the first refrigeration compartment and the second refrigeration compartment. A water dispenser is contained in the horizontal rail and is held stationary in the refrigeration appliance. An electronic user interface is contained in the horizontal rail and held stationary in the refrigeration appliance. The water dispenser and the electronic user interface are arranged to be accessible from a front of the refrigeration appliance while the doors are open or closed. A drip tray is formed in said openable door of said second refrigeration appliance below said water dispenser.

These and other aspects and details of the present invention will become apparent upon a reading of the detailed description and a review of the accompanying drawings. Specific embodiments of the present invention are described herein. The present invention is not intended to be limited to only these embodiments. Changes and modifications can be made to the described embodiments and yet fall within the scope of the present invention.

DETAILED DESCRIPTION OF THE PREFERRED EMBODIMENTS

The present invention finds particular utility in a domestic refrigerator having a fresh food compartment located below a freezer compartment, however, the invention can be used in other refrigeration appliances having different configurations. In order to provide a disclosure of the invention, the embodiment of a refrigeration appliance with a freezer compartment located above a fresh food compartment is shown and illustrated, it being understood that the scope of the invention is not limited to such an arrangement.

Figure 1:
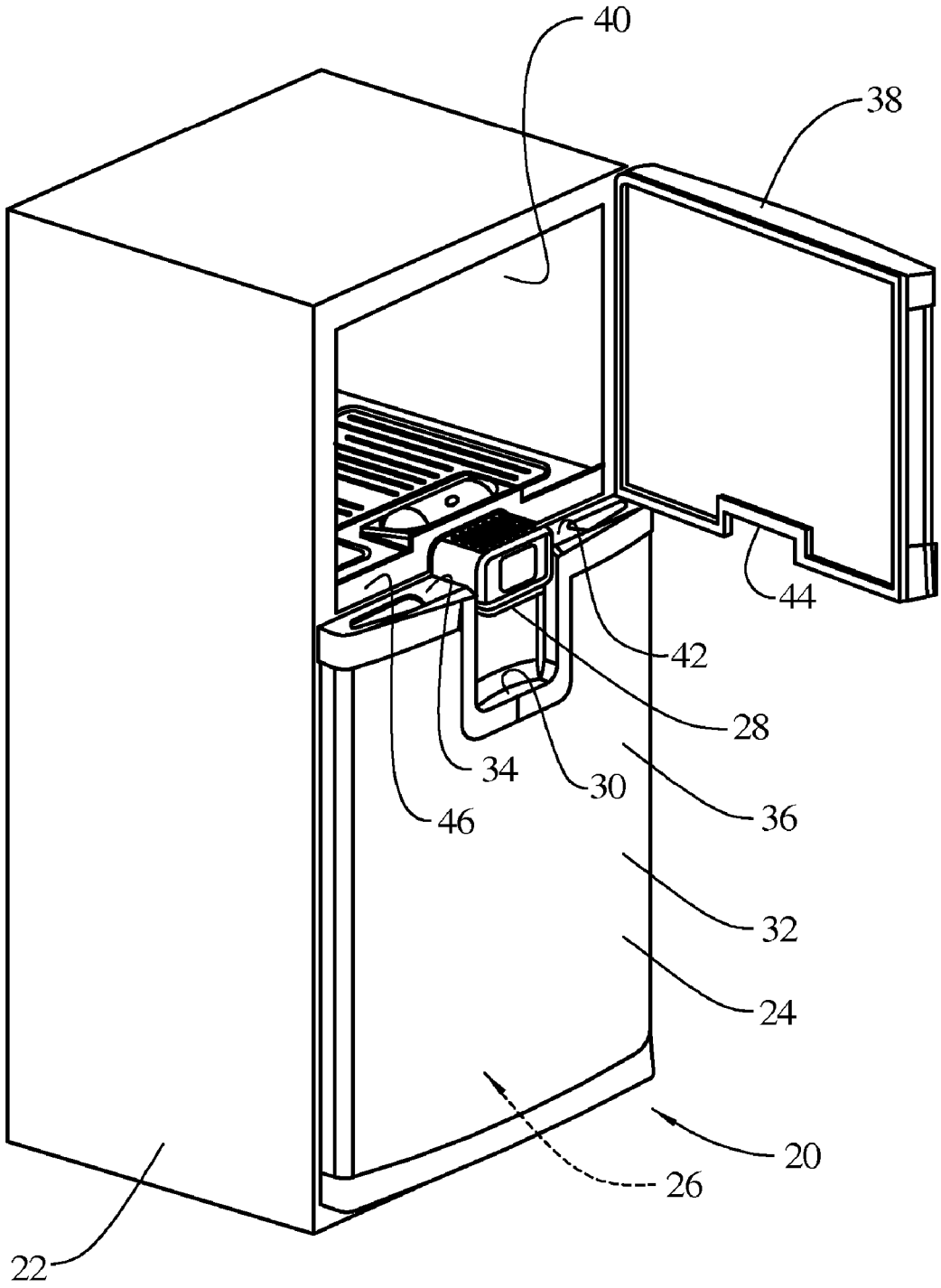
FIG. 1 is a perspective view of a refrigeration appliance embodying the principles of the present invention.

FIG. 1 illustrates a refrigeration appliance 20 which includes a cabinet 22 with an openable door 24 providing access to a refrigeration compartment 26. A dispenser 28, such as a water dispenser, may be contained in the refrigeration appliance 20, accessible from an exterior of the refrigeration appliance while the door 24 is closed. The dispenser 28 is arranged to be stationary relative to the refrigeration appliance 20 while the door 24 is open or closed. A drip tray 30 is formed in an exterior side 32 of the openable door 24 below the dispenser 28. As illustrated, the drip tray may be formed in a top 34 and front 36 surface of the door 24. When the door 24 is opened, the drip tray 30 moves away from the dispenser 28, permitting the dispenser to be used with larger receptacles than can be accommodated with the drip tray positioned under the dispenser.

In more particular detail, the embodiment shown in FIG. 1 shows the refrigeration appliance 20 as having the cabinet 22 with a first openable door 38 providing access to a first refrigeration compartment 40 and the second openable door 24 providing access to the second refrigeration compartment 26. The second openable door 24 has a portion thereof 42 positioned below a portion 44 of the first openable door 38. A rail 46, which may be oriented horizontally as shown or vertically, separates the first refrigeration compartment 40 and the second refrigeration compartment 26. The dispenser 28 may be contained in the rail 46. The dispenser 28 is arranged to be stationary relative to the refrigeration appliance 20 while the doors 24, 38 are open or closed.

The first refrigeration compartment 40 may be a freezer compartment maintained at a temperature below the freezing temperature of water. The second refrigeration compartment 26 may be a fresh food compartment maintained at a temperature above the freezing temperature of water.

Figure 2:
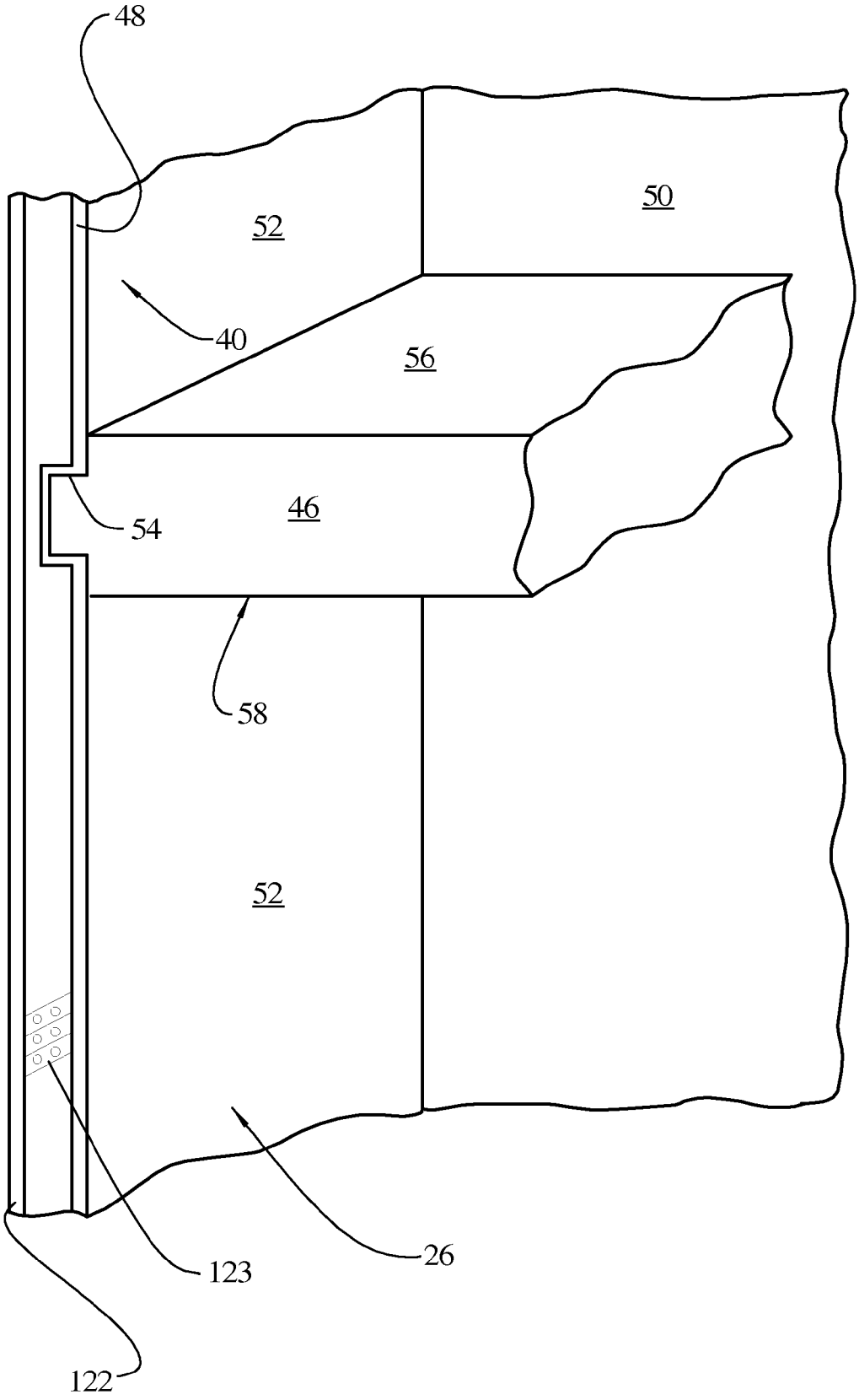
FIG. 2 is a partial perspective view of the interior of the refrigeration appliance of FIG. 1.

As schematically and partially illustrated in FIG. 2, the first refrigeration compartment 40 and the second refrigeration compartment 26 may be formed as an open volume in the appliance 20 by a single plastic liner 48 defining rear 50 and side 52 walls of the compartments, and the rail 46 may be formed as a separate unit to removably and replaceably slidingly mate with grooves 54 in the side walls to define a bottom wall or floor 56 of the first compartment and a top wall or ceiling 58 of the second compartment.

Figure 3:
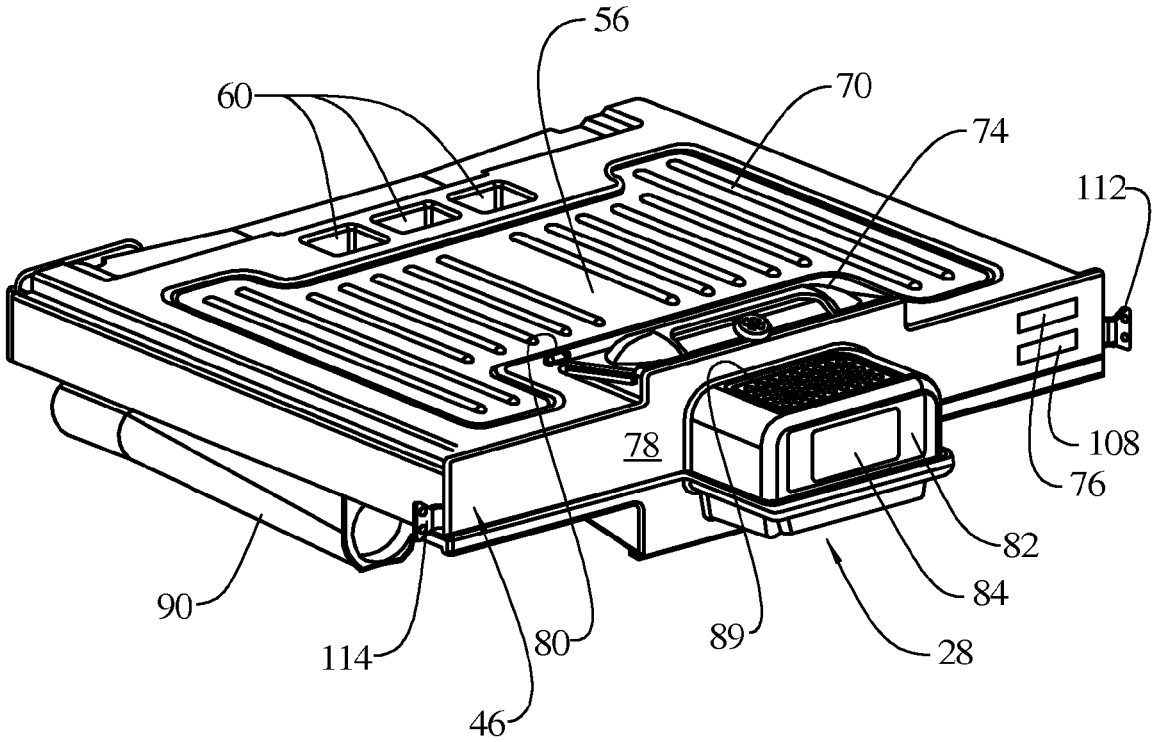
FIG. 3 is a front top perspective view of a rail mounted dispenser in an embodiment of the present invention.

In an embodiment, the horizontal rail 46 extends to the rear wall 50 of the compartments 26, 40 and at least one air flow passage 60 (FIG. 3) is formed in the horizontal rail to permit a flow of air to at least one of the compartments. In such an arrangement, a water supply conduit may lead from the horizontal rail 46 through the rear wall 50 of the refrigeration compartment and to an exterior of the cabinet 22. In this manner, as many of the water components of the appliance 20, such as all of the water components, may be located in the rail 46.

Figure 4:
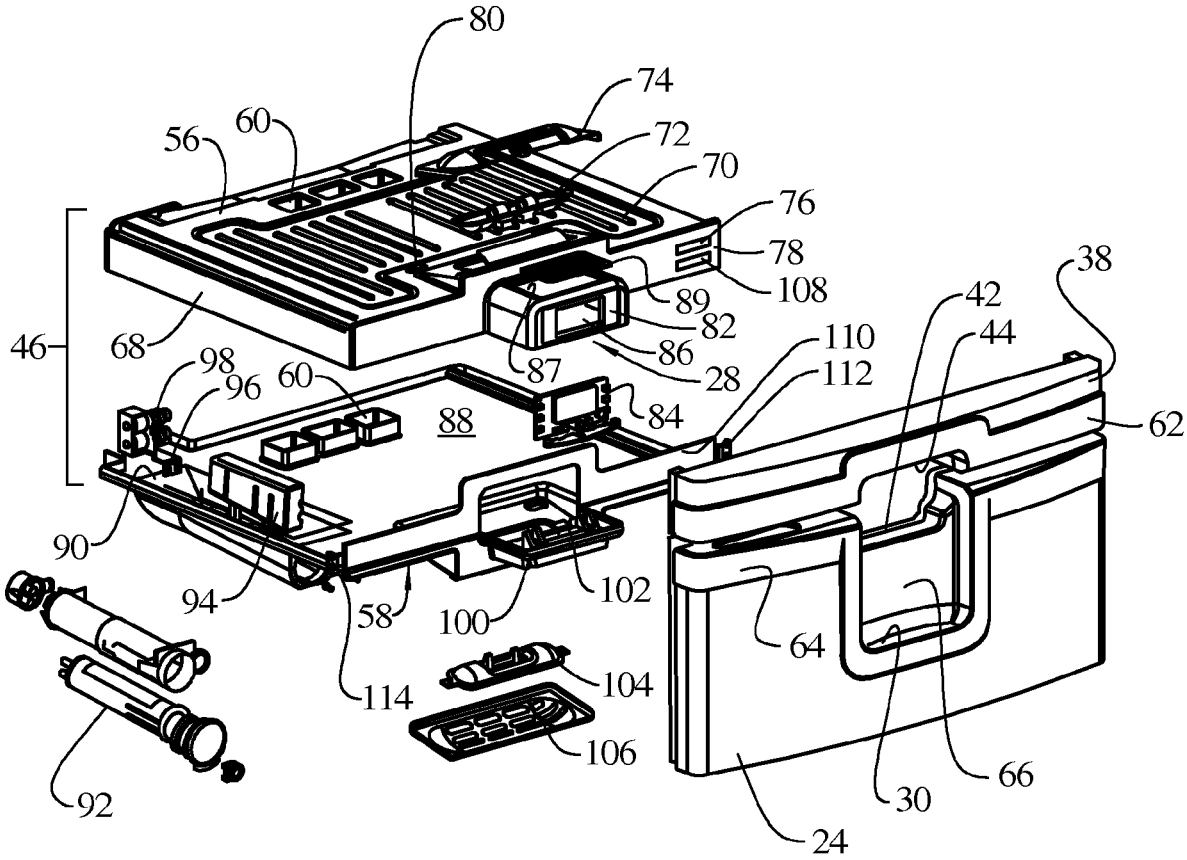
FIG. 4 is an exploded perspective view of the rail mounted dispenser and partial refrigeration appliance doors in an embodiment of the present invention.

FIG. 4 illustrates an exploded view of an embodiment of the invention. In this view, a lower portion of the first door 38 and an upper portion of the second door 24 are shown in a closed position, but moved forwardly of the components of the rail 46 for clarity. The first door 38 is provided with a lower end cap 62 which is contoured at the portion 44 to provide access from a front of the refrigeration appliance 20 to the dispenser 28 when the first door is closed. The second door 24 is provided with an upper end cap 64 which is contoured at the portion 42 to provide access from a front of the refrigeration appliance 20 to the dispenser 28 when the second door is closed. The upper end cap 64, which forms the top surface 34 and a portion of the front surface 36 of the second door 24, also has the drip tray 30 formed therein. The drip tray 30 includes a recess 66 permitting at least partial insertion of a cup, glass or other container below the dispenser 28.

The rail 46, in the embodiment illustrated, comprises a unit that may be assembled separately from the refrigeration appliance 20, as described above. The unit is composed of several components shown in the exploded view of FIG. 4. An upper molded plastic body element 68 forms the floor 56 of the first refrigeration compartment 40, and may include various surface features, such as ribs 70, to prevent articles from sticking to the floor surface during use of the refrigeration appliance 20, particularly when the first compartment is a freezer compartment.

The upper body element 68 may also include a lighting element/reflector 72 and a protective shield/lens 74 for illuminating the interior of the first refrigeration compartment 40. The lighting element 72 may be positioned near a front of the rail 46 so that the lighting will be directed into the interior of the compartment 40 and away from the eyes of the user. The placement at the front will also allow for protection of the lighting element when the door 38 is closed, in that typically, refrigeration appliance doors are provided with interior bins, and the lighting element 72 would be positioned below the door bins when the door is closed. A switch or switch actuator 76 may be located at a front vertical surface 78 of the rail 46 which is engaged by a portion of the first door 38, so that the lighting element will be deenergized when the door is closed and energized when the door is open. The switch 76 may have a movable contact, or may incorporate a touch-sensor style switch that detects door opening/closing when a magnetic field is broken.

The upper body element 68 may also provide an attachment area 80 for a thermistor or other temperature sensing device used to control a temperature of the first refrigeration compartment 40. Placement of the thermistor in the rail 46 will allow for much or all of the wiring necessary for the operation of the refrigeration appliance 20 to be routed to a single location within the refrigeration cabinet 22.

The upper body element 68 may also provide a housing 82 for a control and display printed circuit board 84 comprising an electronic user interface, via which various operations of the refrigeration appliance 20, such as temperatures for the refrigeration compartments 26, 40 and lighting of the drip tray 30 and recess 66 are controlled and displayed. The housing 82 has a window 86 through which the display may be viewed, and inputs to the control may be entered by a user. A top surface 87 of the housing 82 may be provided with a flat work or support surface 89, for receipt of items to be placed into or taken out of the first refrigeration compartment 40, or the top surface may by provided with a convex surface to prevent the placement of items thereon, to prevent damage to the housing.

A lower molded plastic body element 88 forms the top wall 58 of the second refrigeration compartment 26, and may include various features, such as a recess 90 to receive a water filter 92 and a water reservoir 94, a mounting area 96 for water valves 98, the air flow passages 60, and a support 100 for a paddle 102 used to operate the dispenser 28. The dispenser 28 is located behind a front of the housing 82 and does not protrude beyond the front of the housing.

The lower body element 88 may also include a lighting element/reflector 104 and protective shield/lens 106 for illuminating the interior of the second refrigeration compartment 26. The lighting element 104 may be positioned near a front of the rail 46 so that the lighting will be directed into the interior of the compartment 26 and away from the eyes of the user. A switch or switch actuator 108 may be located at the front vertical surface 78 of the rail 46 which is engaged by a portion of the second door 24, so that the lighting element 104 will be deenergized when the door is closed and energized when the door is open. The switch 108 may have a movable contact, or may incorporate a touch-sensor style switch that detects door opening/closing when a magnetic field is broken.

A metal plate 110 is carried in a slot in the lower body element 88 and is received in a slot in the upper body element 68 when the two bodies are assembled together. The metal plate 110 resides directly behind the front vertical surface 78 of the rail 46 and provides a magnetically attractive element to interact with gaskets 111 on the interior side of the doors 24, 38 which carry magnets therein. The magnetic attraction assures that the gaskets 111 will seal tightly against the front vertical surface 78 of the rail 46. The metal plate 110 also includes a right 112 and left 114 support arm for receiving and carrying a hinge for the doors 24, 38, so that the doors may be converted between a right swing opening and a left swing opening as needed by the user. The metal plate 110 further acts as a carrier surface for a heater element, which may be in the form of resistance wires or other conductive element, including conductive inks, to provide a heating of the front vertical surface 78 of the rail 46. A heating of the front vertical surface 78 will prevent condensation from forming on that surface when the temperature of the refrigeration compartments are reduced below the ambient dew point temperature. In an embodiment, as many of the electronic control components of the appliance 20, such as all of the electronic control components, are located in the rail 46.

Figure 5:
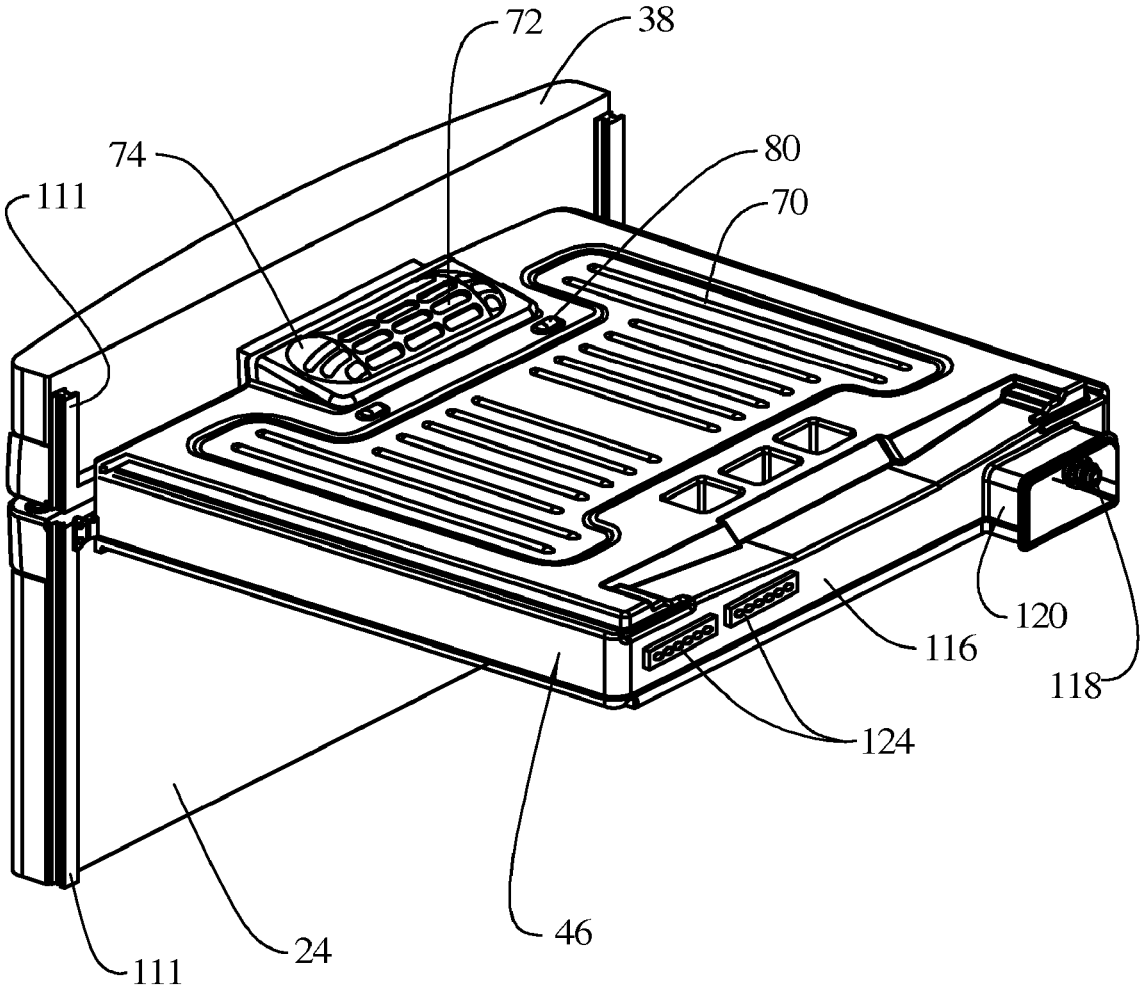
FIG. 5 is a rear perspective view of the rail mounted dispenser in an embodiment of the present invention.

In order to provide water to the dispenser 28, a water supply connection must be provided to the refrigeration appliance, and particularly to the water valves 98. As illustrated in FIG. 5, a rear side 116 of the rail 46 is provided with a water connection fitting 118. This water connection fitting extends rearwardly of the rear side 116 of the rail 46 and is located within a rearwardly open extension 120 of the rail. The extension 120 extends through a gap or space between the plastic liner 48 of the cabinet 22 and an outer metal shell 122 (FIG. 2), in that this gap is normally filled with foamed-in-place insulation 123 once the liner is installed into the shell. The extension 120 therefore seals off the passage that the water conduit travels through and prevents the insulation from leaking out of the cabinet 22 at the water connection opening. The opening to the exterior of the cabinet 22 also helps to prevent the water valves 98 from freezing.

In order to provide electrical power to various components located in the rail 46, an electrical connector 124 may be provided at the rear side 116 of the rail 46. Different components in the rail 46 may use different voltage levels, such as the light elements 72, 104 which may use high (120 volt) voltage, while the control 84 and thermistor may use low (12 volt) voltage. Thus, the electrical connector 124 may have connectors for each of the different voltage levels, and may include connectors for each of the electrical components, such that a single wiring harness may be used within the interior of the rail 46, and a single connection point at the connector 124 on the rear side 116 of the rail 46. Electrical supply wires may be extended in the space between the liner 48 and the shell at the rear of the appliance 20, and may extend through an opening in the rear wall 50 of the liner ending in a plug that mates with the connector 124. Once the space is filled with the foamed-in-place insulation 123, the supply wires and plug will be held in place and the rail 46 may be moved toward and away from the rear wall 50 to make or break the connections with the supply wires as the rail is being removed or reinstalled in the refrigeration appliance 20.

With much or all of the water and electronic control components located in the rail 46, such an arrangement will reduce the wiring and plumbing complexity of the refrigeration appliance 20, and will also allow for several different models of the appliance to be made from a single liner 48 and cabinet 22 configuration, with only the rail with its various water and electronic control components changed between models, to provide different combinations of features in different models, while allowing for manufacturing flexibility. For example, some models may not include a water dispenser, so the rail 46 would contain only electronic control components. In other models, perhaps only the water dispenser would be located in the rail, and the electronic control components would be located elsewhere. Also, some models may have a greater or lesser number of electronic control components, and so the number of components in the rails may vary. Further, if a water component or a control component fails or needs repair, the entire rail 46 can be removed and replace with a new rail, so that the components can be repaired at a repair facility, rather than in the field, resulting in quicker and more efficient service calls.

Figure 6:
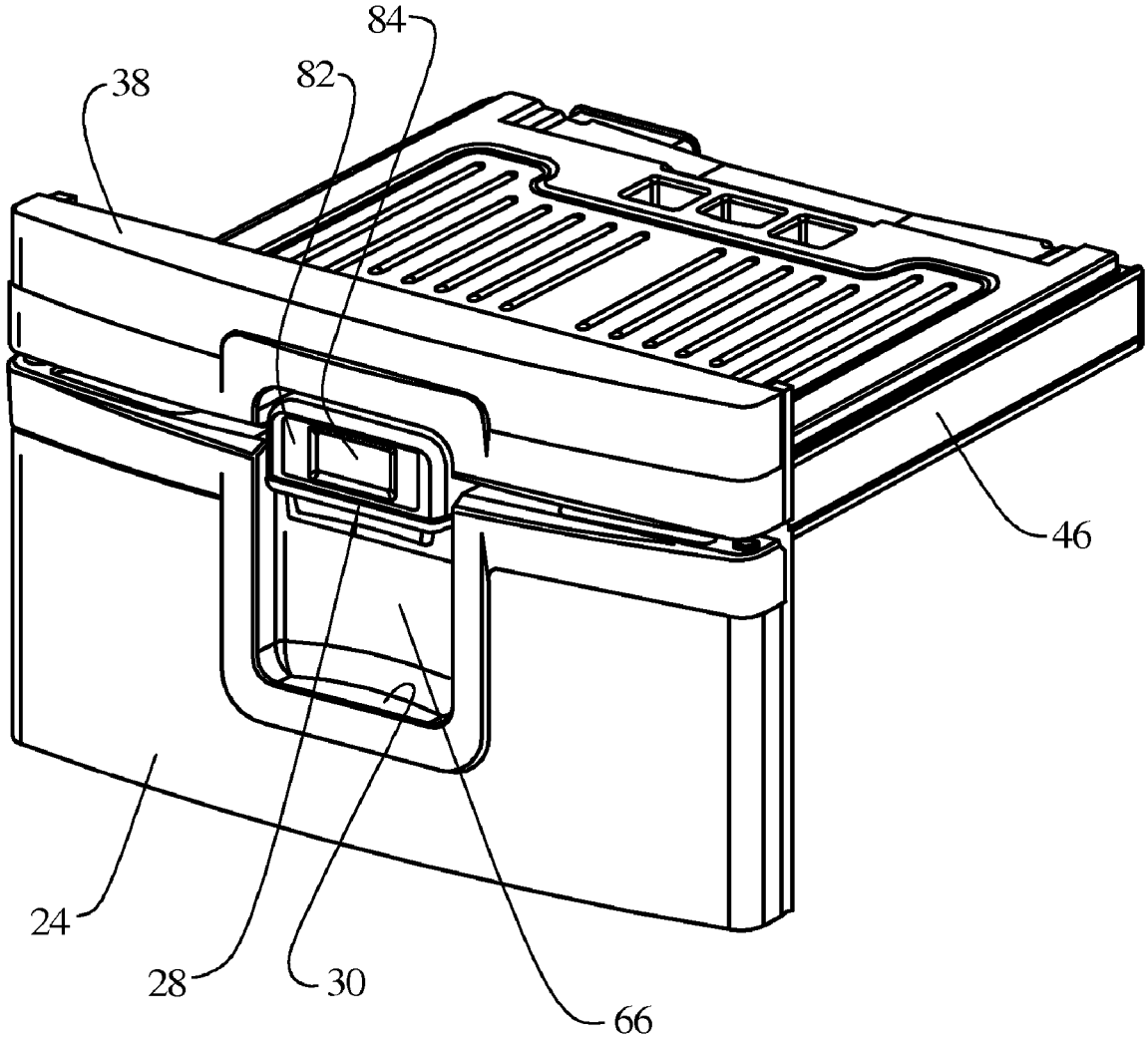
FIG. 6 is a front perspective view of the rail mounted dispenser and partial refrigeration appliance doors in an embodiment of the present invention.

As illustrated in FIG. 6, when the doors 24, 38 are closed, the housing 82 containing the dispenser 28 and the control and display 84 is exposed and accessible at the front of the refrigeration appliance 20. In the embodiment illustrated, the front of the housing 82 is flush with the front of the doors 24, 38, although other arrangements could be provided. The drip tray 30 and the recess 66 are positioned below the dispenser 28.

Various embodiments of the invention may provide one or more of the following benefits and improvements: all electronics are centrally located, reducing wiring cost and assembly complexity; user interface adjustments may be made when the appliance door is open; the dispenser may be operated when the appliance door is open; the complexity of the lower door endcaps is reduced since wiring and water lines do not need to be routed through the door; there is reduced complexity in water and wire routing since the connections are made directly to the rail area; the user doesn't have to wait for colder water from the reservoir since the dispenser is located much closer to the reservoir and the water conduit does not exit the interior of the refrigeration compartment; improved lighting locations will direct illumination along a line of sight of the user, rather than into the user's eyes; the open or closed position of the door may be detected without a moving component switch; the useable space in the fresh food compartment is increased since the electronic control assembly is moved to the rail; electrical and water routing in the grill area is eliminated; the dispenser components may all be contained in the rail unit, allowing easy removal and replacement of the single component for servicing, by sliding the unit out of and back into the slots in the liner; fewer electrical and water connections are required; no changes to wiring or water conduits are required for door reversibility; extra wire and tubing previously required is no longer required; and the functionality and quality of the dispenser and control can be confirmed prior to assembly of the components to the refrigeration appliance cabinet, since they are all contained in a single unit.

The present invention has been described utilizing particular embodiments. As will be evident to those skilled in the art, changes and modifications may be made to the disclosed embodiments and yet fall within the scope of the present invention. For example, various components could be utilized separately or independently in some embodiments without using all of the other components in the particular described embodiment. The disclosed embodiment is provided only to illustrate aspects of the present invention and not in any way to limit the scope and coverage of the invention. The scope of the invention is therefore to be limited only by the appended claims.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

The embodiments of the invention in which an exclusive property or privilege is claimed are defined as follows:

1. A refrigeration appliance comprising:

a cabinet with an openable door providing access to a refrigeration compartment; and a dispenser contained in said refrigeration appliance, accessible from a front exterior of said refrigeration appliance while said door is closed and mounted to a stationary portion of said refrigeration appliance so as to remain stationary while said door is opening or closing;

said dispenser being located in a housing having a front which is flush with a front of the openable door of the refrigeration appliance, with the dispenser being located behind the front of the housing so as not to protrude beyond the front of the housing; and said dispenser being located in a body forming a ceiling of and being exposed to said refrigeration compartment.

2. A refrigeration appliance according to claim 1, further including an electronic user interface in said unit containing said dispenser.

3. A refrigeration appliance according to claim 1, wherein said dispenser comprises a water dispenser.

4. A refrigeration appliance according to claim 1, including a recess, sized to receive a receptacle for the dispenser to dispense into, and a drip tray both being located beneath the dispenser, the drip tray being mounted to the openable door of the refrigeration appliance so as to move away from the dispenser to permit a larger receptacle to be used with the dispenser than could be accommodated with the drip tray positioned under the dispenser.

5. A refrigeration appliance according to claim 1, wherein the dispenser is located in a separate, removable unit.

6. A refrigeration appliance according to claim 1, including electronic control components for said dispenser, said electronic control components being located in a separate, removable unit.

7. A refrigeration appliance comprising:

a cabinet with an openable door providing access to a refrigeration compartment;

a dispenser contained in said refrigeration appliance, accessible from an exterior of said refrigeration appliance while said door is closed, said dispenser being mounted to a stationary portion of said refrigeration appliance so as to remain stationary relative to said refrigeration appliance while said door is opening or closing; and a drip tray formed in a top and front surface of said openable door below said dispenser.

8. A refrigeration appliance according to claim 7, wherein said dispenser is incorporated into a unit forming a ceiling of said refrigeration compartment.

9. A refrigeration appliance according to claim 7, further including an electronic user interface in said unit containing said dispenser.

10. A refrigeration appliance according to claim 7, wherein said dispenser comprises a water dispenser.

11. A refrigeration appliance according to claim 7, wherein the body that the dispenser is located in is a separate, removable unit.

12. A refrigeration appliance according to claim 7, including electronic control components for said dispenser, said electronic control components being located in a separate, removable unit.

13. A refrigeration appliance comprising:

a cabinet with an openable door providing access to a refrigeration compartment;

a dispenser positioned in said refrigeration appliance above a top surface of said door, said dispenser being accessible from a front exterior of said refrigeration appliance while said door is closed and arranged to be stationary relative to said refrigeration appliance while said door is opening or closing;

said dispenser being located in a housing which has a front substantially flush with a front surface of said openable door, said dispenser being located behind said front of said dispenser housing so as not to protrude beyond said front surface of said door;

a recess formed in said top and front surfaces of said door beneath said dispenser and sized to receive a receptacle for said dispenser to dispense into;

a drip tray being located in said recess beneath said dispenser, said drip tray being mounted and arranged on said door to move away from said dispenser as said door is opened to permit a larger receptacle to be used with said dispenser than could be accommodated with said drip tray positioned under said dispenser.

14. A refrigeration appliance according to claim 13, wherein said dispenser is incorporated into a unit forming a ceiling of said refrigeration compartment.

15. A refrigeration appliance according to claim 13, further including an electronic user interface in said unit containing said dispenser.

16. A refrigeration appliance according to claim 13, wherein said dispenser comprises a water dispenser.

17. A refrigeration appliance according to claim 13, wherein the dispenser is located in a separate, removable unit.

18. A refrigeration appliance according to claim 13, including electronic control components for said dispenser, said electronic control components being located in a separate, removable unit.

* * * * *

UNITED STATES PATENT AND TRADEMARK OFFICE

CERTIFICATE OF CORRECTION

PATENT NO. : 7,673,471 B2
APPLICATION NO. : 12/017359
DATED : March 9, 2010
INVENTOR(S) : Egan et al.

It is certified that error appears in the above-identified patent and that said Letters Patent is hereby corrected as shown below:

Column 8, line 27, change "unit" to --body--.

Column 8, line 60, change "7" to --8--.

Column 10, line 10, change "13" to --14--.

Signed and Sealed this

Thirtieth Day of November, 2010

David J. Kappos

David J. Kappos
*Director of the United States Patent and Trademark Office*